United States Patent [19]

Augier et al.

[11] 4,231,198

[45] Nov. 4, 1980

[54] JOINTING DEVICE FOR LONG-LIMBED FRAMEWORK ELEMENTS IN REINFORCED CONCRETE AND FRAMEWORK COMPRISING FRAMEWORK ELEMENTS JOINTED BY SUCH DEVICES

[75] Inventors: Robert Augier; Jean P. Carbonari, both of Sorgues; Jean Eliche, Les Angles, all of France

[73] Assignee: Societe Anonyme de Recherche et d'Etudes Techniques, Le Pontet, France

[21] Appl. No.: 971,842

[22] Filed: Dec. 21, 1978

[30] Foreign Application Priority Data

Dec. 29, 1977 [FR] France ..... 77 39653

[51] Int. Cl.[3] ..... E04B 7/02; E04B 7/12

[52] U.S. Cl. ..... 52/91; 52/18; 52/93; 52/726; 403/171; 403/172; 403/174; 403/178

[58] Field of Search ..... 52/18, 90, 93, 726, 52/91; 403/171, 172, 178, 400, 174

[56] References Cited

U.S. PATENT DOCUMENTS

| | | | |
|---|---|---|---|
| 1,232,447 | 7/1917 | Horne | 403/174 X |
| 1,505,680 | 8/1924 | Walker | 403/178 |
| 1,622,746 | 3/1927 | Truemper | 403/174 X |
| 2,255,270 | 9/1941 | Pimm | 403/310 |
| 2,334,355 | 11/1943 | Russell | 52/639 |
| 2,384,719 | 9/1945 | Anderson | 52/18 X |
| 3,333,875 | 8/1967 | Tracy | 52/648 X |
| 3,901,613 | 8/1975 | Anderson | 403/174 X |
| 4,065,890 | 1/1978 | Fenner | 403/172 X |
| 4,125,973 | 11/1978 | Lendrihas | 52/91 |

FOREIGN PATENT DOCUMENTS

| | | | |
|---|---|---|---|
| 869416 | 3/1953 | Fed. Rep. of Germany . | |
| 1955760 | 2/1971 | Fed. Rep. of Germany . | |
| 505193 | 4/1920 | France . | |
| 929324 | 7/1947 | France . | |
| 992962 | 7/1951 | France . | |
| 1191091 | 4/1959 | France . | |
| 2312626 | 12/1976 | France | 52/91 |
| 540397 | 10/1941 | United Kingdom | 52/90 |
| 670705 | 4/1952 | United Kingdom | 52/93 |
| 131761 | 5/1951 | Sweden | 52/93 |

*Primary Examiner*—Alfred C. Perham
*Attorney, Agent, or Firm*—Kane, Dalsimer, Kane, Sullivan and Kurucz

[57] ABSTRACT

A jointing device for long-limbed framework elements in reinforced concrete and framework comprising framework elements jointed by such devices.

Means are provided for housing with a tightening fit the ends of the sections to be assembled. In a realization said means comprise a body from which depend at least two sleeves provided for housing with a tightening fit a portion of the sections to be assembled. The sleeves are preferably removably fixed to the body.

37 Claims, 10 Drawing Figures

JOINTING DEVICE FOR LONG-LIMBED FRAMEWORK ELEMENTS IN REINFORCED CONCRETE AND FRAMEWORK COMPRISING FRAMEWORK ELEMENTS JOINTED BY SUCH DEVICES

The invention relates to a device for jointing together framework elements in reinforced concrete, prestressed or not, for instance beams, posts or similar. It relates also to frameworks comprising an assembly of such elements connected to each other by such jointing devices.

A framework means here a bi- or tri-dimensional structure.

For the jointing of beams, posts or similar long-limbed elements, in reinforced concrete, prestressed or not, one has so far called upon concrete embedding reinforcement irons extending beyond the ends of the beams or posts to be jointed. Such a jointing operation is complex and costly to carry out.

It has also been proposed to use jointing sleeves cooperating with a bolt or a peg extending through holes in the sleeve and through holes provided at the ends of the concrete elements to joint. But it is not easy to drill a hole at the end of a beam or a post in reinforced concrete, and moreover the element is weakened and the jointing effort is excessively concentrated.

The object of the invention is to provide a jointing device for beams, posts or similar in concrete, easy and economical to manufacture and easy to put in practice.

The invention is based on the findings according which, when tightening forces are applied at the periphery of a beam or of a post or any other long-limbed element in reinforced concrete, said beam or post is not damaged even if said tightening forces have a high value.

The device according to the invention is characterized in that, being provided for jointing two beams or posts or any other long-limbed elements in reinforced concrete, particularly by their end, it comprises at least a sleeve capable of enclosing with a tightening fit at least a beam or a post.

The length of the sleeve is chosen such that the forces developped at its junction with the concrete forming the element do not run the risk of deteriorating the structure of the latter.

The invention foresees taking in account the flexural moment which may have a high value and results from the flexural moments which are always present in the vicinity of a jointing junction.

In the case of a non prestressed concrete element, the length of the sleeve is chosen so as to avoid the collapse of the concrete under the effect of high pressures applied by one face of the sleeve on the element.

In the case where the jointed element is in prestressed concrete, the length of the sleeve is sufficient so that in the part of the element which is subjected to the tension due to the existence of the flexural moment or moments, the efforts developed are inferior to the tensile efforts which can be supported by concrete.

The length resulting from this second condition is usually greater than that resulting from taking in account the first condition only.

With a similar aim in view, the invention provides reinforcing the ends of the jointed elements by embedding metallic fibres in the concrete.

Thus, it is not necessary to modify or shape the ends of the element for their jointing.

The beams or posts thus jointed may form a framework or ossature the solidity of which is at least as high as that of frameworks provided by beams or posts in reinforced concrete jointed with the devices of the prior art.

In an embodiment, the jointing device comprises a body from which extend at least two sleeves provided each for housing with a tightening fit one portion and particularly the end of the concrete sections to be jointed. It is advantageous that the sleeve be removably attached to the body.

In an embodiment, the body or sheel is formed with a central cavity and at least one communication opening between said central cavity and the sleeve so as to allow the introduction in said cavity of the end of the section enclosed in the sleeve.

In the case where the device has two sleeves in alignment, it may be advantageous to foresee such a communication opening between each sleeve and the body cavity so that a section may extend across the body.

With an assembly formed with reinforced concrete sections, prestressed or not, and of jointing devices according to the invention, it is easy to form a framework such as that of the building such as a shed. The jointing devices are in the latter case used for making the jointing of (vertical) posts with (non vertical) ridge elements such as binding rafters or principal rafters.

One may also use such jointing devices for associating together ridge elements.

The sections may slide easily inside the sleeves and/or the bodies of the jointing devices before their locking in the sleeves through a tightening fit; the assembly and adjustment of a framework are thereby particularly easy.

Further aims, advantages and features of the invention will become apparent from the following description of some embodiments thereof, with reference to the accompanying drawings wherein.

Figure 1:
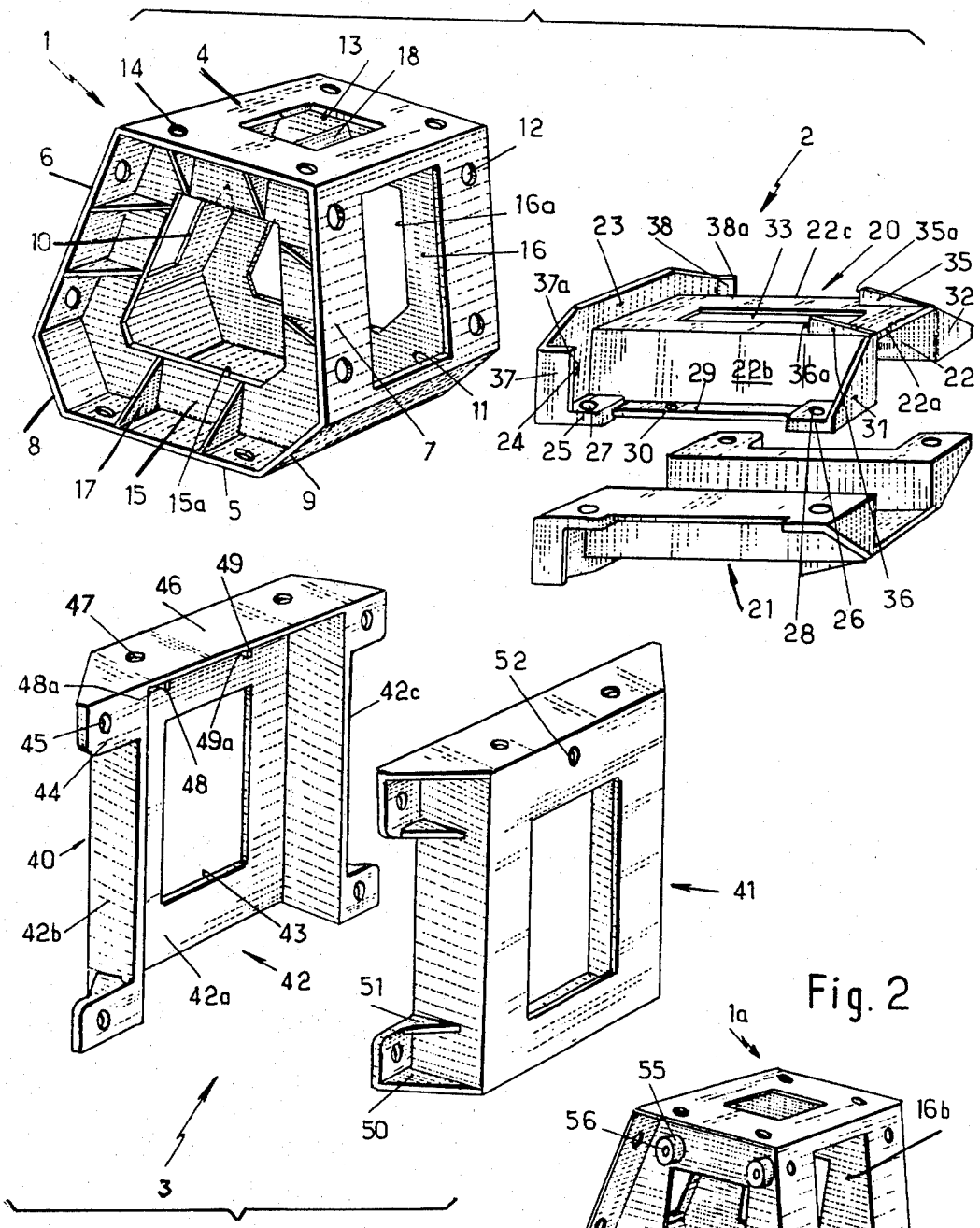
FIG. 1 is an exploded perspective view of a jointing device according to the invention.

The jointing device shown in FIG. 1 comprises a hollow body 1 and two sleeves 2 and 3 for tightening the ends (or other portions) of sections (not shown in the Figure) in reinforced concrete, prestressed or not. The sleeves are removably fixed to the body 1 through fixation means such as screws and nuts.

The body 1 has two parallel faces 4 and 5 hereafter called upper and lower faces, such indications imposing nevertheless no limitation as to the position in which the device is used. Said faces 4 and 5 are interconnected by side faces 6 and 7 adjacent parallel edges of face 4 and by faces 8 and 9, of smaller length (according to their cross-section in a vertical plane) than faces 6 and 7 and connecting on the one hand face 6 to the lower face 5 and on the other hand the side face 7 to the lower face 5. The body 1 has therefore in a vertical cross-section the shape of an irregular hexagon. The body 1 has a plane of symmetry which is perpendicular to faces 4 and 5, face 6 being symmetrical to face 7 relative to said plane; likewise, face 8 is symmetrical to face 9 relative to said plane.

Faces 6 and 7 are formed with openings 10 and 11 of rectangular shape the width of which is half their length. The cross-section of said openings corresponds to that of the sections to be jointed. They are provided for allowing the introduction of the section ends into the hollow body 1. Their shapes and dimensions are such that a clearance is provided between the edges of said openings and the associated section, when present. Around the openings 10 and 11 (for instance opening 11), are distributed oblong or oval holes 12 which, in the example, are four in number and distributed on the corners of a square.

The upper face 4 is formed with a square-shaped opening 13 the sides of which are equal to the width of the side of the rectangular opening 10 or 11. Faces 4 and 5 are also formed with ovalized holes 14 distributed in the shape of a square having the same side length as the side of the square where the holes 12 are distributed.

Inside the volume limited by faces 4 to 9, are provided two flanges 15 and 16 parallel to each other and perpendicular to said faces. Said flanges are arranged so that the portion of said faces 4 to 9 which are outside the space separating them form edges where the openings 10 and 11 are not present, but contain ovalized holes 12, 14, etc. Each flange 15, 16 has a central opening, respectively 15*a*, and 16*a* with edges parallel to its outside edges. Gussets 17 form reinforcement ribs for body 1 and are provided outside said space which separates flanges 15 and 16 and at the connection of said flanges with faces 4, 5, 6 and 7.

Finally, as regards body 1, it comprises in its hollow portion situated between flanges 15 and 16 and in the vicinity of the medium portion of the upper face 4 a stop abutment 18 with edges substantially parallel to faces 6 and 7 for the ends of the beams or posts which are introduced in the hollow portion of the body.

The sleeve 2, which is provided for being fixed to body 1 on its face 7 has two portions or half sleeves 20 and 21 which are identical. Therefore, it will be sufficient to describe one of such parts, viz. part 1. The latter comprises a reversed U-shaped section 22 for capping the upper face and the upper portions of the side faces of a beam or post of rectangular cross-section and with a width slightly smaller than that of the base (or central edge) 22*a* of section 22. Of course, as already mentioned as regards the positions of faces 4 and 5 of body 1, the expression "upper" or "lower" is used here for the sake of the commodity of the description but not as representing the real position of the elements thus indicated.

The half sleeve 20 has a rear front edge 23 formed in the vicinity of its side ends with circular holes 24 the distance of which between their axes is equal to that between the axes of holes 12. Said holes 12 and 24 are provided for the passage of bolt stems for the fixation of sleeve 2 onto body 1.

The half sleeve 20 is flanged in its lower portion and at its four corners with ears 25, 26, etc. Thus, ear 25 is connected to the rear end of a wing 22*b* of section 23 and to the lower rim of edge 23. Said ears 25, 26 are formed with holes 27, 28 through which extend tightening screws (not shown).

Between ears 25 and 26 is provided a rib 29 formed with a hole 30 which, in the example, is closer to ear 25 than to ear 26.

The half sleeve 20 is also formed with anterior frontal ribs 31 and 32. Each of said ribs, for instance rib 31, is integral with on the one hand the adjacent ear 26 and on the other hand with the corresponding wing 22*b* of section 22.

The upper face of the central wing 22*a* of section 22 is formed with a rectangular opening 33 and from the outer face (on top on the figure) of said central wing 22*a* extend in the vicinity of its front end, ribs 35 and 36 having in their rear portion edges, respectively 35*a* and 36*a* forming, as will be seen later in connection with FIG. 3, positioning abutments for posts or binding rafters. Also for ensuring such a positioning, the edge 23 is continued forewardly by edges 37 and 38 substantially parallel to the wings 22*b* and 22*c* and formed with front edges 37*a* and 38*a*.

In order to allow the tightening, the height of wings 22*b* and 22*c* is smaller than the half height of the corresponding beam or post.

The sleeve 3 has also two identical portions 40 and 41, each of which, for instance the half sleeve 40, has the shape of a U-shaped section 42 with a large base 42*a*, which is formed with a rectangular opening 43. The side wings 42*b* and 42*c* of section 42 are flanged at their ends and on their free edges with ears 44 formed with circular holes 45 provided for the passage of the tightening means such as screws, with a tendency of bringing the half sleeves 40 and 41 nearer to each other in order to tighten the end of a beam or post between said half sleeves.

The half sleeve 40 has an upper face 46 formed with circular holes 47 separated by a distance equal to that separating the corresponding holes provided on face 5 of body 1.

Inside section 42, the face 46 is formed, between the holes 47, with ribs 48 and 49 having lower edges, respectively 48*a* and 49*a* forming abutments for an end of the beam or post introduced in the sleeve 3.

Ribs or gussets 50 and 51 (half sleeve 41, FIG. 1) connecting the outside face of a wing of the section to an edge of a corresponding ear are provided for improving the mechanical rigidity of the half sleeve. The central wing of the section is formed with a hole 52 (which on FIG. 1 is only visible on the half sleeve 41) between the ribs extending beyond the corresponding upper face.

Face 46 is provided for being applied against the lower face 5 of body 1 and the holes 47 provide passage for fixation means, for instance screws and bolts, for the sleeve 3 onto body 1. Said means have a head which can be lodged in the portion of the sleeve left free between the end of the beam or post and face 46.

As will become apparent later in connection with FIG. 3, the holes 52 provide passage for draw-rods extending transversely through the sleeve in the space separating ribs 48 and 49 and left free due to the fact that a beam or post tightened between the half sleeves 40 and 41 cannot get into said space.

The distance separating the wings 42*b* and 42*c* is slightly superior to the width of a beam or post the end of which is normally introduced into the sleeve 3. The width of said sleeves 42*b* and 42*c* is smaller than the half width (as seen in a transverse direction relative to the abovementioned width) of the instant beam or post, so as to allow the tightening of the end of the beam or post between the two half sleeves 40 and 41.

In the case of a framework provided for a slope of 25 %, the angle formed between faces 4 (or 5) and 6 (or 7) of body 1 is of the order of 76° so that the angle formed by said face 4 or 5 with the general direction of sleeve 2—and therefore with the beam introduced into said sleeve—is of the order of 14°, representing a slope of said value.

The body 1 and the sleeves 2 and 3 are preferably made of metal such as malleable cast iron. However, in an alternative embodiment, the jointing device is made of a resin concrete, or of a reinforced resin (the resin being for instance polyester), or in concrete wherein metallic fibres have been incorporated, or in concrete reinforced with glass fibres, or again in a laminated product with layers of glass fibres and polyester.

Figure 2:
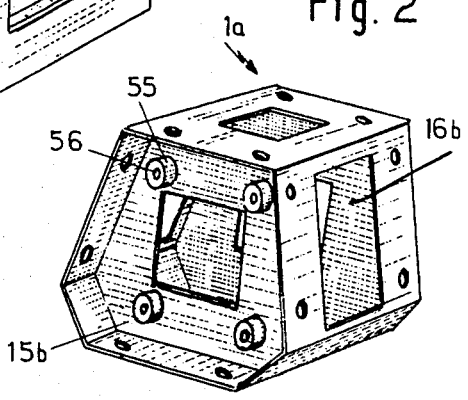
FIG. 2 shows an alternative embodiment of a body of the device shown in FIG. 1.

The body 1*a* of the jointing device which is shown in FIG. 2 is different from body 1 of FIG. 1 in that the faces 15*b* and 16*b* (corresponding to faces 15 and 16) are formed with four bosses 55 through which are drilled tapped holes 56. Said tapped holes are distributed in the same manner as the ovalized holes provided on other faces of body 1*a* and allow the fixation of sleeves similar to sleeves 2 and 3.

Figures 3, 5, 9, 10:
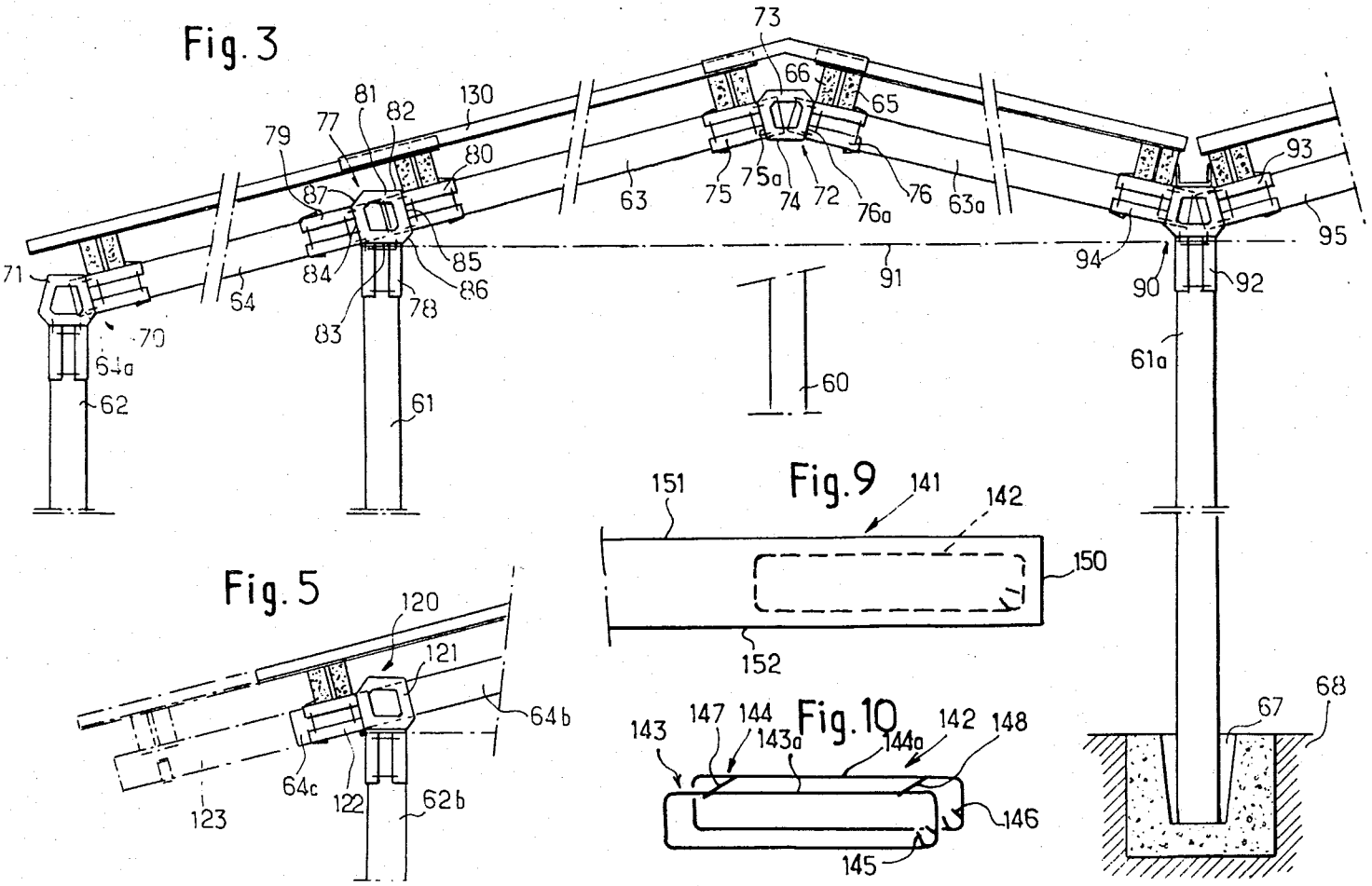
FIG. 3 is a vertical cross-section of a framework according to the invention and comprising jointing devices of the type shown in FIG. 1.
FIG. 5 is a partial view, similar to that of FIG. 3, of an alternative embodiment of the framework.
FIG. 9 shows the end of a beam.
FIG. 10 shows a reinforcement or trussing embedded in the beam end shown in FIG. 9.
Figure 4:
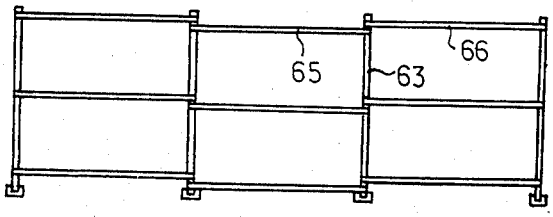
FIG. 4 is a top view at a reduced scale of a portion of the framework shown in FIG. 3.

The framework shown in FIGS. 3 and 4 is made of reinforced concrete sections, prestressed or not, of rectangular or square cross-section, as well as of jointing devices of the type shown in FIG. 1.

In this example, the vertical posts are of square cross-section and there are provided central posts 60 of longer length, posts 61 of intermediate length and side or pent roof posts 62 of still shorter length.

The truss of said framework comprises principal rafters 63 and 64—the rafters 63 being longer than the rafters 64—and binding rafters 65, 66 of equal length as regards each other.

The principal rafters and the binding rafters have all the same rectangular cross-section.

The bases of posts 60, 61, 62 are driven in shafts 67 provided in a concrete flagstone 68. The fixation of said post bases is ensured by filling the shafts 67 with concrete (not shown).

As an alternative, the posts comprise at their base pedestals formed with holes provided for their fixation on a flagstone with sealing bolts.

The jointing of post 62 to the principal rafter 64 is achieved by using a device 70 identical to that shown in FIG. 1 and arranged in the same manner. The end 64*a* of the principal rafter 64 is introduced inside body 71 of the jointing device 70, the end face of said principal rafter being in contact with a face of the inner abutment of said body (abutment 18 in FIG. 1).

The post 60 (the upper end of which has not been shown) is connected to two principal rafters 63 and 63*a* through a jointing device 72 similar to that shown in FIG. 1. The body 73 of the device 72 is identical to body 1 of the device shown in said FIG. 1, but is reversely arranged in a vertical direction. The upper portion of post 60 is fixed through a sleeve (not shown) to face 74 of device 73 corresponding to face 4 of body 1 (FIG. 1). The principal rafters 63 and 63*a* are fixed to body 73 through sleeves 75 and 76 fixed to the latter on its faces 75*a* and 76*a* corresponding respectively to faces 6 and 7 of body 1. Moreover, the ends of said principal rafters 63 and 63*a* are introduced into body 73.

The jointing of the principal rafters 63 and 64 with post 61 is provided by a jointing device 77 with sleeves 78, 79 and 80 which are identical, as regards sleeve 78 to sleeve 3 (FIG. 1) and as regards sleeves 79 and 80 to sleeve 2 of the device shown in FIG. 1. The sleeve 78 maintains with a tightening fit the upper end of post 61, whereas sleeves 79 and 80 maintain with a tightening fit the ends of the principal rafters 64 and 63 respectively. The body 81 of device 77 has, as body 1, the shape of an irregular hexagon but, contrary to said body 1, its outer faces are parallel two by two. Said body 81 has an upper face 82 and a lower face 83 which are horizontal. At the lower face 83 is adjacent a face 84 on which is fixed sleeve 79. Said face 84 forms with the horizontal an angle of 104° about so that the inclination of the principal rafter 64 relative to the horizontal is equal to 14° (slope of 25%). The sleeve 80 is fixed to a face 85 of body 81 which is parallel to face 84. Faces 86 and 87 of smaller dimensions are respectively located between face 83 and face 85, and face 84 and face 82.

Contrary to the jointing devices 70 and 72, the device 77 provided therefore the possibility of jointing two main rafters in the prolongation of each other.

The body 81 of said device 77 is not formed in its central cavity with a limiting abutment for the introduction of beams or similar.

In a symmetrical position of post 61 relative to post 60, the shed shown in FIG. 3 comprises a post 61*a* fixed to the main principal rafter 63*a* through a jointing device 90 having a body identical to body 71 of device 70.

A horizontal draw-rod 91 formed of a metallic rod is provided between sleeve 78 and the vertical sleeve 92 of device 90. The ends of said draw-rod 91 are passed through the openings of said sleeves corresponding to openings 52 of sleeve 3 shown in FIG. 1.

The device 90 comprises an extra sleeve 93 symmetrical to sleeve 94—surrounding the end of the principal rafter 63*a*—relative to the vertical. Said sleeve 93 surrounds the end of a principal rafter 95 which is part of an extension of the shed.

The binding rafters are fixed to the rest of the framework also through the jointing devices already described. However, the ends of said binding rafters are not tightened between half sleeves but sit on the upper faces of the half sleeves enclosing the principal rafters with which they are jointed. Thus, the ends of the binding rafters 65 and 66 sit on the upper face of the upper half sleeve 76. As already mentioned hereabove, the side positioning of said binding rafters is ensured through edges 35*a*, 36*a*, 37*a*, 38*a* (FIG. 1) of said half sleeve. Moreover, the fixation of said ends of the binding rafters to the sleeves is provided by hooks (not shown) in the shape of a reversed L the lower end of the longer branch of which being threaded and passed through the holes 30 of the half sleeves (FIG. 1) where they are maintained by a nut (also not shown). The smaller branch of said L-shaped hook sits on the upper face of the binding rafters 65 and 66.

Figure 6:
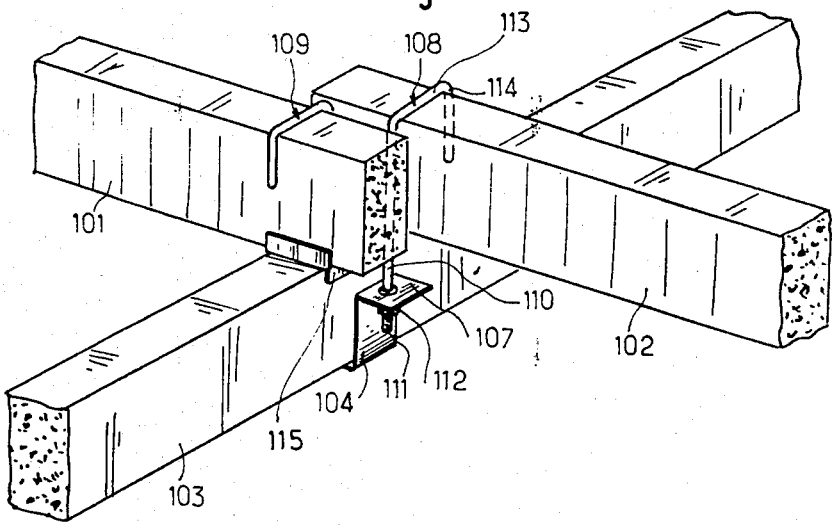
FIGS. 6 to 8 show further jointing means according to the invention for sections which may be used in the framework shown in FIG. 3.
Figure 7:
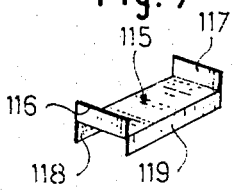
Figure 8:
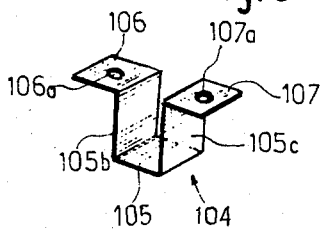

The jointing of the binding rafters to the common rafters is provided by other means shown in FIGS. 6, 7 and 8. The binding rafters 101 and 102 of rectangular cross-section, which have the same direction but are off-set one relative to the other, sit with their smaller side on the upper edge of a common rafter 103 which is also a rectangular shaped section in reinforced concrete, prestressed or not. The jointing means comprise a piece 104 the central portion of which is U-shaped (FIG. 8) and the base of which 105 is applied against the lower edge of the profiled common rafter 103 and the side wings of which 105*b* and 105*c* which have a height inferior to that of the common rafter are applied against the side faces of said common rafter 103. The upper ends of the wings 105*b* and 105*c* are extended outwardly by edges 106 and 107 formed each with a central hole, respectively 106*a* and 107*a*.

Said jointing means comprise moreover hooks 108 and 109. Hook 108 is provided for the fixation of binding rafter 102 to common rafter 103 and hook 109 provides the fixation of binding rafter 101 to common rafter 103. Each hook, for instance that indicated by numeral reference 108, has a vertical rod 110 the lower end of which 111 is threaded and extends through hole 107*a* and with which cooperates a nut 112 placed under the edge 107. The vertical rod 110 is continued at its upper portion by a horizontal branch 113 which is applied against the upper edge of binding rafter 102, and said branch 113 ends by a vertical angled portion 114 directed downwardly and which is applied against a vertical edge of binding rafter 102.

Finally and as regards the jointing means of the binding rafters with the common rafters, said binding rafters 101 and 102 do not sit directly on the upper edge of common rafter 103 but through a metallic retention part 115 (FIG. 7) having edges 116 and 117 directed upwardly and enclosing the opposed vertical edges of the binding rafters 101 and 102. This part has also vertical edges 118 and 119 directed downwardly and covering the upper portion of the opposed vertical edges of common rafter 103.

The roofing is made of plates 130 in asbestos-cement covering the binding rafters. As an alternative, said plates 130 are made of steel and, advantageously, an insulation is sandwiched between said steel plates and the binding rafters.

The longitudinal wind bracing of the shed framework may be provided in any manner known per se, for instance by providing full walls or elements arranged as a St Andrew's cross. The draw-rods 91 as well as the sleeves enclosing the ends of the principal rafters provide the wind bracing following the slope.

The length of the sleeves is chosen such that the pressure developed by the existence of flexural moments does not risk to deteriorate the structure of the concrete in contact with the sleeve.

In the case where the long-limbed element is in prestressed concrete, the length of the jointing sleeve is chosen such that no stresses appear in the portion of the element which is subjected to the tension due to the existence of such a flexural moment which would be superior to those which prestressed concrete can normally support, taking in account the fact that the stress of the concrete arising from its cooperation with the reinforcement is smaller at the ends of the element.

In the case where the sections are in prestressed concrete, particularly with adherent reinforcement, the tightening length of the sleeves on the sections is advantageously such that the prestress is sufficiently established just out of the sleeve so as to make the fixing-in effective.

In an example, the tightening strength of the sleeves on the end of a prestressed concrete section forming a principal rafter is of the order of 37 cm.

In order to facilitate the establishment of a prestress, it is advantageous to reinforce the ends of the beams or posts by metallic hoops. Thus, in the example shown in FIGS. 9 and 10, in the end portion of a beam 141 is embedded a reinforcement 142 formed of two parallel rectangular frames 143 and 144 arranged so as to form a rectangular parallelepiped. Each frame is formed from a metallic wire closed by a loop 145, 146 improving the anchoring of the reinforcement 142 in the concrete. The upper branches 143*a* and 144*a* of said frames are welded in the vicinity of their ends to wires 147 and 148 perpendicular to them. In an embodiment, the length of the frames 143 and 144 is of about 110 cm, their width of about 12.5 cm and the distance separating them of the order of 5 cm. In this case, the wires 147 and 148 are at about 10 cm of the respective small sides of the rectangular frames, the small side which is closest to the end face 150 of beam 141 being at about 3 cm of the latter and the width of said face 150 being of the order of 20 cm.

The half sleeves of the jointing device are arranged so that the tightening strength is exerted on the side faces 151 and 152 of the beam which are parallel to the plane defined by wires 147 and 148.

It is also possible to reinforce the ends subjected to the tightening by adding embedded metallic fibres when manufacturing the concrete, regularly distributed in its mass through a mixing operation.

Referring now to FIG. 5, an alternative embodiment of the shed shown in FIG. 3 will now be described. In this alternative embodiment, the pent roof post 62*b* is fixed to a principal rafter 64*b* through a jointing device 180 similar to the jointing device 77 of the principal rafters 63 and 64 with post 61. The principal rafter 64*b* extends entirely through body 61 of device 120 and the end 64*c* of said principal rafter extends beyond the outside of the shed while being enclosed in a sleeve 122 fixed to body 121. Said end 64*c* supports a porch-roof 123 shown in phantom in FIG. 5. It will be noted here that it is not necessary to foresee inside the shed an extra tightening sleeve for the principal rafter 64*d*.

As shown in the hereabove description, the framework according to the invention is of a particularly simple realization. The various elements composing it are easily stored and need a reduced space whereas the previously known frameworks with a reinforced concrete base, prestressed or not, were particularly bulky. Moreover, said framework may be made in extremely different dimensions. Moreover, in the example described, only two types of sections, viz. square shaped and rectangular shaped sections only have been used, thereby facilitating the jointing of the framework while keeping the manufacturing costs at a low level. From this point of view, it will also be appreciated that the same jointing device may be used on the ridge of a roof for the connection of two principal rafters (device 72 of FIG. 3) and for the jointing of a pent roof post with a principal rafter (device 70, FIG. 3).

The sections may easily slide inside the sleeves and/or the bodies of the jointing devices, before locking the sections in the sleeves through tightening with screws and bolts. The mounting of the framework is thereby particularly easy and may even be carried out by a person having no particular competence in the framework field.

Although in the described example, the jointing devices are usable only for roofings having a slope of the order of 25%, it goes without saying that the invention is not limited to such a slope value. Moreover, it is possible by using a body of a jointing device having inclinable faces to build roofings of different slopes. For producing such a disposition, the side faces of the body (not shown) and corresponding to the faces 6 and 7 (FIG. 1) are pivotally connected to a base (corresponding to face 5) and the upper face is made of a plate having dimensions which are a function of the inclination of the side faces. Said upper plate is in this case fixed to the side faces through bolts used also for the fixation of the sleeves to the side faces of the body.

It is also to be noted that the fact that the binding rafters are not placed end against end (FIGS. 4 and 6), but off-set, simplifies further the mounting of the shed and, simultaneously, provides a sufficient support for said binding rafters on the principal rafters and the common rafters.

The shed according to the invention is easily taken to pieces. Moreover, its shape may be easily modified; for instance, it can be extended, as can be seen with the principal rafter 95 of FIG. 3.

Finally, as regards the advantages of the framework and the jointing device according to the invention, it is to be noted that the sections are not provided with reinforcements ready at their ends and that they can manufactured with the same molding installation and cut to the desired length by sawing directly on the pre-manufacturing bench.

The invention applies also to the case where the sections do not have metallic reinforcements but are sections made of prestressed concrete reinforced with metallic fibres or glass fibres.

We claim:

1. A device for jointing together at least two reinforced concrete long-limbed construction elements or sections, comprising a body, at least two sleeves connected to said body, and means for tightening said sleeves so as to respectively clamp construction elements or sections therebetween.

2. A device according to claim 1, wherein the intersection of the medium lines of the sleeves is inside the body.

3. A device according to claim 1 comprising means for the removable fixation of the sleeves to the body.

4. A device according to claim 1 wherein the body is formed with a central cavity and at least one opening for communicating between said central cavity and a sleeve so as to allow the introduction of the end of a corresponding section into said cavity.

5. A device according to claim 4, wherein the cavity of the body is provided with a limitating abutment for the introduction of a section into said body.

6. A device according to claim 4, wherein the body is formed with an opening in register with the communication opening between one of the sleeves and the central cavity so as to provide passage, through the body, of a section to be received with a tightening fit into said sleeve.

7. A device according to claim 3, wherein the body has plane outside faces.

8. A device as defined in claim 7 wherein said sleeves include plane faces which are applied on the plane outside faces of the body.

9. A device according to claim 8, wherein the plane outer faces of the body and the corresponding plane faces of the sleeve are formed with holes in register for the passage of removable fixation means.

10. A device according to claim 9, wherein the holes have on all the faces the same distribution as to their shape and dimensions, whatever the cross-section of the sections to be jointed.

11. A device according to claim 10, wherein said holes are four in number and are positioned at the corners of a square.

12. A device according to claim 1 wherein at least one of the sleeves has abutment means for limiting the introduction of a section in the bottom of said sleeve so as to leave a free space between the end of the section maintained by a tightening fit in the sleeve and the bottom of said sleeve.

13. A device according to claim 12, wherein the sleeve is formed with openings for providing passage, extending transversely relative to the direction of the sleeve, for a rod extending through said free space.

14. A device as defined in claim 12 comprising means for the removable fixation of the sleeve to the body and wherein said free space is occupied in part by the fixation means of the sleeve to the body.

15. A device according to claim 1, wherein each sleeve has two distinct portions likely to be connected to each other by tightening means.

16. A device according to claim 15, wherein the two portions of each sleeve are identical.

17. A device according to claim 1, wherein an outer face of at least one of the sleeves includes positioning abutments.

18. A device according to claim 17, wherein the sleeve comprises further means for providing the fixation of hooking means of another section to the sleeve.

19. A device according to claim 1 wherein the body and the sleeve are made of metallic cast iron.

20. A device according to claim 1 wherein the body and the sleeves are made of resin concrete.

21. A device according to claim 1 presenting as a whole a plane of symmetry, at least one sleeve extending in said plane and at least two sleeves extending according to two symmetrical directions relative to said plane.

22. A device according to claim 1 wherein the length of the sleeves on which the tightening action of the reinforced concrete sections is applied is chosen with a value sufficient for providing the fixing-in of the corresponding sections.

23. A device according to claim 22, wherein the length of the sleeves is sufficient for avoiding the deterioration of the concrete-in pressure contact with said sleeves under the effect of the flexural moment.

24. A device as defined in claim 18 wherein said further means includes holes in said sleeve.

25. A device as defined in claim 1 wherein the body and the sleeves are made of concrete reinforced with metallic fibers.

26. A device as defined in claim 1 wherein the body and the sleeves are made of concrete reinforced with glass fibers.

27. A device for jointing together at least two reinforced concrete long-limbed construction elements or sections, comprising a hollow body having a plurality of faces defining a polygon;

a pair of flanges, each perpendicularly attached to said faces and parallel to each other, said faces and said flanges defining a cavity in said body, and said flanges defining a pair of openings;

an opening formed in at least one of said faces for communicating between said cavity and on a sleeve so as to allow the introduction of an end of a construction element or section into said body;

a first sleeve attached to said face having said opening, said sleeve comprising two distinct U-shaped sections for accommodating a construction element or section;

a pair of ears extending from each of said U-shaped sections, each of said ears including a plurality of holes therein for accommodation of tightening screws;

a second sleeve attached to another face of said body, said sleeve comprising two distinct U-shaped sections for accommodating a construction element or section; and a pair of ears extending from each of said U-shaped sections of said second sleeve, each of said ears including a plurality of holes therein for accommodation of tightening screws.

28. A device as claimed in claim 27 wherein at least two of said faces are parallel to each other, and said body has a plane of symmetry which is perpendicular to said parallel faces.

29. A device as claimed in claim 27 wherein a stop abutment is provided within said cavity.

30. A device as claimed in claim 27 wherein said first sleeve includes positioning abutments on its outer surface.

31. A device as claimed in claim 27 wherein said sleeves and said body include registrable holes such that said sleeves are removably attached to said body.

32. A device as claimed in claim 27 wherein at least one of said sleeves includes abutment means for limiting the introduction of an element or section in the bottom of said sleeve.

33. A device as claimed in claim 27 or claim 28 wherein said body is in the form of a hexagon.

34. A framework for a building comprising reinforced concrete elements, said elements including vertical posts, principal rafters, and binding rafters, and at least one device jointing together at least two of said sections, said device comprising a body, at least two sleeves connected to said body, and means for tightening said sleeves so as to respectively clamp concrete sections therebetween.

35. A framework as described in claim 34 wherein said binding rafters are fixed to the principal rafters through hooking means attached between sleeves of jointing devices enclosing the ends of the principal rafters, and said binding rafters.

36. A framework as defined in claim 34 wherein the ends of the binding rafters rest upon the edges of the principal rafters, two consecutive binding rafters having the same direction being off-set relative to each other.

37. A framework as defined in claim 34 wherein the length of said sleeves is sufficient for avoiding the deterioration of the concrete in pressure contact with said sleeves under the effect of flexural movement.

* * * * *

UNITED STATES PATENT AND TRADEMARK OFFICE

CERTIFICATE OF CORRECTION

PATENT NO. : 4,231,198

DATED : November 4, 1980

INVENTOR(S) : Robert Augier, Jean-Pierre Carbonari and Jean Eliche

It is certified that error appears in the above—identified patent and that said Letters Patent is hereby corrected as shown below:

Claim 19, column 10, line 31, "metallic" should be --malleable--.

Signed and Sealed this

*Third* Day of *March 1981*

[SEAL]

*Attest:*

RENE D. TEGTMEYER

*Attesting Officer*

*Acting Commissioner of Patents and Trademarks*